United States Patent [19]

Leduc et al.

[11] 3,981,630

[45] Sept. 21, 1976

[54] HYDRAULIC SWASH PLATE PUMPS

[76] Inventors: Gérard Leduc, 88, rue d'Alsace, 88 Saint-Die; Michel Leduc, 54 Azerailles, both of France

[22] Filed: May 27, 1975

[21] Appl. No.: 580,973

[30] Foreign Application Priority Data

June 19, 1974 France ..... 74.21247
Feb. 28, 1975 France ..... 75.06331

[52] U.S. Cl. ..... 417/269
[51] Int. Cl.[2] ..... F04B 1/12
[58] Field of Search ..... 417/269, 271; 91/6.5

[56] References Cited

UNITED STATES PATENTS

| | | | |
|---|---|---|---|
| 2,821,932 | 2/1958 | Lucien | 417/269 |
| 3,498,227 | 3/1970 | Kita | 417/269 |

FOREIGN PATENTS OR APPLICATIONS

| | | | |
|---|---|---|---|
| 558,548 | 9/1956 | Italy | 417/269 |
| 517,210 | 6/1941 | United Kingdom | 417/269 |

*Primary Examiner*—William L. Freeh
*Assistant Examiner*—G. P. LaPointe
*Attorney, Agent, or Firm*—Darby & Darby

[57] ABSTRACT

A swash plate pump of the type wherein a plurality of pistons bear against the swash plate and are given a reciprocating movement when the plate is rotated by a drive shaft. The drive shaft comprises a solid portion and a hollow portion which latter constitutes a central admission conduit for the liquid to be pumped. The swash plate is mounted at the junction between the solid and hollow portions of the shaft, and the plate has an aperture which communicates with the central conduit and a crescent-shaped port for liquid distribution to the pistons. These pistons are arranged in a circle concentric with the solid shaft portion. A taper roller bearing is mounted on the hollow shaft portion and the front face of the swash plate bears against the roller bearing. The discharge flow of liquid can be divided for distribution into several separate flows by a cylindrical sleeve located on the solid shaft portion.

12 Claims, 9 Drawing Figures

HYDRAULIC SWASH PLATE PUMPS

BACKGROUND OF THE INVENTION

The present invention relates to improvements in hydraulic pumps of the swash plate type, that is to say pumps comprising a plurality of pistons arranged in a circle, these pistons bearing against a plate driven by a driving shaft, the plate being inclined relatively to the driving shaft in such a manner that the pistons are given a reciprocating movement when the plate is driven by the shaft.

The improvements according to the present invention are intended to improve the volumetric efficiency of the pump, improving on the one hand the fluid admission conditions and on the other hand the fluid discharge conditions from the pump, more particularly for multiple-delivery pumps.

In order to improve the supply conditions for the pump, it has already been proposed in French Pat. No. 1,409,274 to partly hollow out the swash plate in order to obtain a centrifuging effect on the hydraulic liquid, which accelerates the flow of the said liquid; futhermore in French Pat. No. 71,20091 there was described a pump wherein the liquid arrives directly at the centre of the swash plate by means of a bore formed in the middle of the circle of pistons.

These two arrangements combined with one another have already allowed a very considerable improvement in the delivery of the pump at high speeds of rotation but, the aim of the present invention, is to provide a still greater improvement by using an additional centrifuging effect produced by a taper roller bearing situated in the pump to absorb the mechanical stresses produced by the reaction of the pistons on the rotating swash plate.

SUMMARY OF THE INVENTION

For this object, the pump is constituted by a rotary shaft of which a solid portion constitutes the driving shaft and another hollow portion constitutes the central admission conduit for the liquid; a swash plate mounted on the shaft at the junction between the solid portion and the hollow portion, the said plate comprising an aperture communicating on the one hand with the said central conduit for liquid admission and on the other hand with a cresent-shaped port for distribution of the liquid to the pistons; a group of pumping pistons arranged in a circle concentrically with the solid portion of the shaft and bearing on the rear face of the swash plate; a taper roller bearing mounted on the hollow portion of the shaft, the front face of the said swash plate bearing against the said roller bearing.

Preferably, the discharge flow of the liquid is divided and distributed into several separate flows by means of a cylindrical sleeve arranged about the solid portion of the shaft.

In a preferred form the sleeve comprises internal apertures formed at different levels and also grooves situated on the surface of the sleeve, so as to provide communication between certain pistons and an outlet determined by means of the apertures and the grooves.

According to a second preferred constructional form the sleeve comprises as many circular grooves as the pump is to comprise separate deliveries, whilst the pump body comprises a plurality of ducts parallel to the pumping cylinders, to a number equal to that of the cylinders, each duct communicating on the one hand with a cylinder downstream of its discharge valve and on the other hand with one of the circular grooves formed in the sleeve.

BRIEF DESCRIPTION OF THE DRAWINGS

An embodiment of the present invention will now be described, by way of example, with reference to the accompanying drawings, in which.

DESCRIPTION OF THE PREFERRED EMBODIMENT

Figure 1:
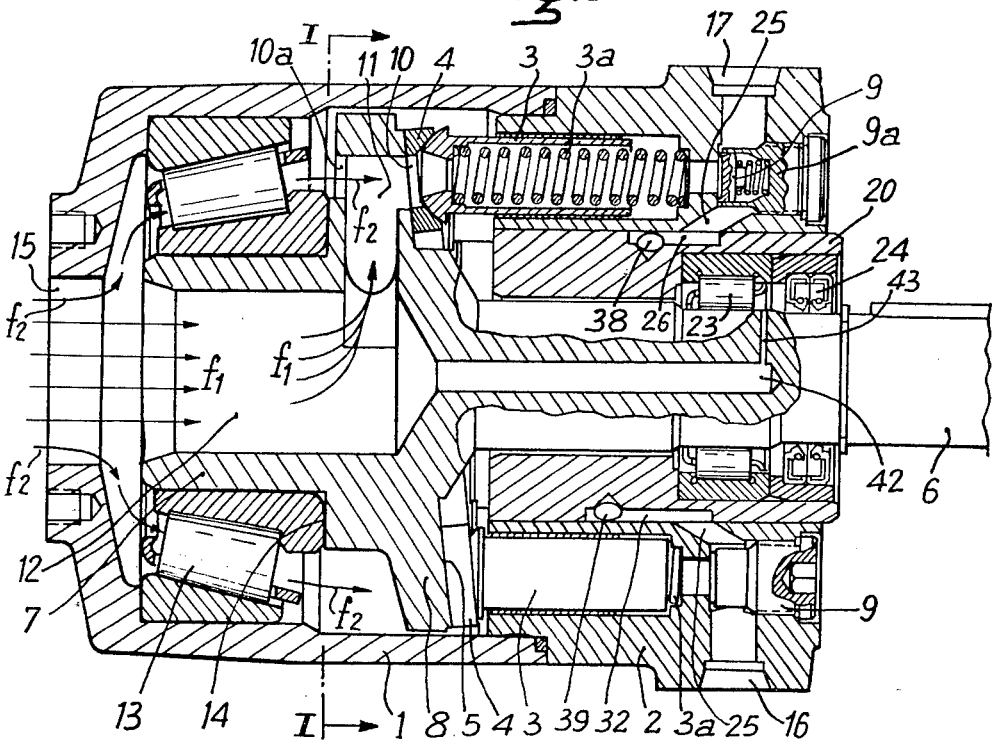
FIG. 1 shows a view in longitudinal section of the pump according to the present invention.

Referring now to FIG. 1, it can be seen that the pump comprises a casing 1 and a cylinder head or barrel 2. Within the barrel 2 there are arranged in a circle a plurality of pistons 3 which in the example illustrated amount to twelve in number.

These pistons 3 rest by means of studs against the rear face of a swash plate 8 which in the example illustrated is integral with the pump shaft; this shaft being constituted by a solid portion 6 which acts as a driving shaft, and a hollow portion 7 which acts as a supply conduit.

The pistons 3 are held at the other end by springs 3a and the cylinders in which they can move are provided with non-return valves 9.

When the solid portion 6 of the shaft is driven by any desired kind of motor, the pistons 3 are given a reciprocating movement. As the stud 4 of a piston passes over the crescent-shaped port 10 the hydraulic liquid is drawn through the interior of the piston and this liquid is then delivered through the non-return valve 9.

The crescent-shaped port 10 communicates with an aperture 11 forming a perforation through the body of the swash plate 8, so that the liquid situated in the aperture 11 is centrifuged when the swash plate 8 rotates.

The aperture 11 communicates with the bore 12 which is formed in the portion 7 of the shaft, this bore constituting a liquid admission duct.

On the portion 7 of the shaft in abutment against the front face 14 of the plate 8 there is situated a taper roller bearing 13 which has the function of receiving the reaction produced by the pistons 3 when they carry out their delivery stroke.

The port 10 is formed right through the swash plate, whose front face 14 comprises an aperture 10*a*.

The hydraulic liquid passes through the orifice 15 formed in the casing 1, and then is brought by way of the conduit 12 to the aperture 11 where it is accelerated by centrifugal force and from there it passes through the port 10 into the pistons 3 as the studs 4 of the pistons concerned pass over the port in the flow path indicated by the arrows $f_1$.

However, a substantial portion of the liquid arriving at orifice 15 passes through the taper roller bearing 13, in the direction of arrows $f_2$, which acts in a similar manner to a centrifugal pump, to increase the supply pressure of the liquid. In order to facilitate the passage of the hydraulic liquid, in the direction indicated by the arrows $f_2$, the aperture 10*a* connects with the port 10.

This arrangement affords several advantages: first of all in the pumps previously described comprising a central conduit making it possible to bring the liquid directly to the centre of the plate, from where it could be centrifuged by the rotary movement of the swash plate and the aperture provided therein, the liquid was pumped by the pistons in the direction opposite to the direction in which it arrives at the plate, that is to say it was necessary to make the liquid carry out a change in direction of 180°, which gave rise to pressure losses.

On the other hand this new arrangement makes it possible to use the centrifugal pump effect caused by the taper roller bearing, which accelerates the liquid arriving at the conduit 12 and subjects the chamber in which the swash plate moves, to a slight pressure. Thus a considerable improvement in the efficiency of the pump is obtained at rotational speeds of the shaft 6 above 2500 revolutions per minute, whereas in the usual pump, on the contrary, a considerable fall in efficiency is found beyond a threshold round about this rotational speed.

Figure 2:
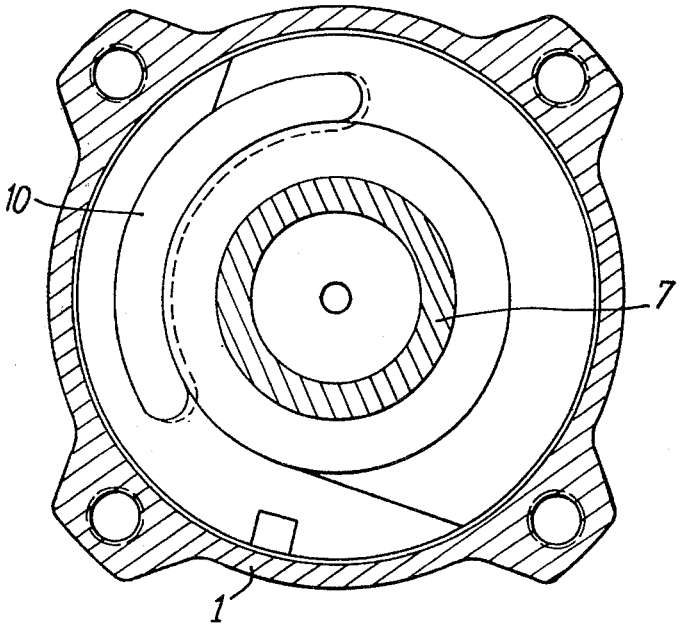
FIG. 2 shows a sectional view taken on the line I—I of FIG. 1.
Figure 3:
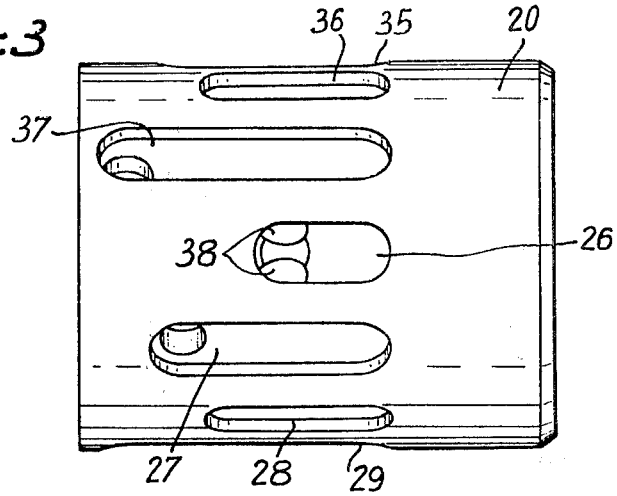
FIG. 3 shows a view of a detail illustrating a first constructional form of a flow distributing sleeve.
Figure 4:
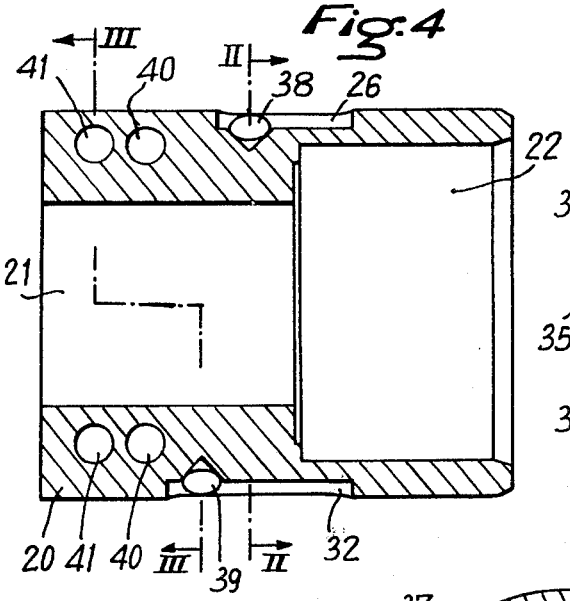
FIG. 4 shows a view in longitudinal section of the sleeve shown in FIG. 3.
Figure 5:
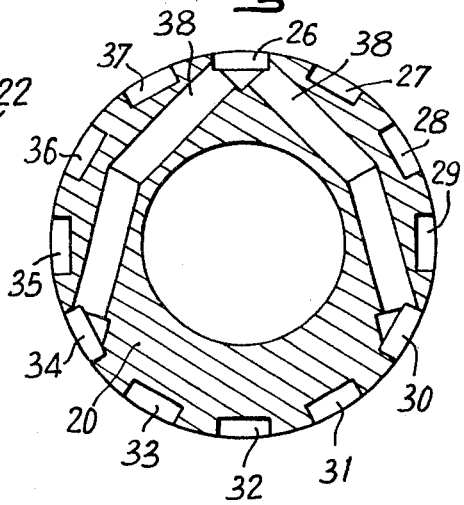
FIG. 5 shows a cross-sectional view taken on the line II—II of FIG. 4.
Figure 6:
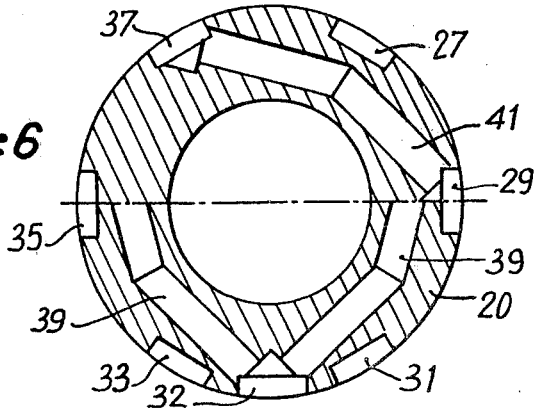
FIG. 6 shows a cross-sectional view taken on the line III—III of FIG. 4.

The pump shown in FIGS. 1 and 2, as already stated, is a multiple-delivery pump, in the example illustrated four deliveries. This means that the deliveries of the pistons 3 are grouped in threes and directed towards independent outlets such as 16 or 17.

This grouping and this distribution of deliveries is obtained by means of a cylindrical sleeve 20.

Referring now particularly to FIGS. 3 to 6, it can be seen that the sleeve 20 is hollow and the shaft 6 passes through its internal bore 21, comprising a cylindrical shoulder 22 intended to receive a bearing 23 for the shaft and a rotary sealing element 24 (See also FIG. 1).

Cut on the external wall of the sleeve 20 are 12 grooves 26 to 37 each corresponding to a piston 3 and communicating with this piston by means of a duct 25 coming from the corresponding non-return valve 9.

The grooves 26, 30 and 34 are connected to one another by two ducts 38 formed in the body of the sleeve 20; the grooves 28, 32 and 36 are connected to one another by two ducts 39; the grooves 27, 31 and 35 are connected to one another by two ducts 40; the grooves 29, 33 and 37 are connected to one another by two ducts 41. The ducts 38, 39, 40 and 41 are at different levels and as a result the grooves are also of different lengths, the grooves 26, 30 and 34 being the shortest, the grooves 28, 32 and 36 slightly longer, the grooves 27, 31 and 35 slightly longer still, and the grooves 29, 33 and 37 being the longest.

Thus, the liquid displaced by the piston 3 situated at the top of FIG. 1 lifts the non-return valve 9 and uses the outlet duct 17 whereas in turn the two other pistons situated at 120° at the two sides of the piston 3 in the circle of pistons in the barrel, displace the liquid, after having lifted the respective non-return valve associated with each of them, using a duct of the type 25, the groove 30 and 34, the double duct 38, the groove 26, the duct 25, and, passing round the plug 9a, to discharge at outlet duct 17.

Furthermore, the liquid displaced by the piston 3 situated at the bottom of FIG. 1 will be delivered by way of the outlet duct 16 after having repelled the non-return valve 9, and the liquid displaced by the pistons situated at 120° on the two sides of the latter will use the ducts 25, the grooves 28 and 36 and then both of the ducts 39 to reach the groove 32 and from there to outlet duct 16.

Preferably, and as is illustrated in FIG. 1, a considerable clearance is left between the wall of the shaft 6 and the internal wall of the sleeve 20 so that the hydraulic liquid which is situated in the space in which the swash plate 8 can move is able, since it is slightly under pressure, to flow in the cylindrical space thus formed and thus lubricate the bearing 23.

The shaft 6 comprises an axial 42 communicating by way of a duct 43 with the space in which the bearing 23 is situated.

The duct 42 opening into the conduit 12 at the centre of the plate 8, the liquid situated in the duct 43 is drawn in by the centrifugal effect due to the movement of the plate 8. As a result the flow of the liquid between the shaft 6 and the sleeve 20 and then through the bearing 23 is effected regularly and without difficulty.

During comparative tests it has been found that by combining the centrifugal effect produced by the swash plate, the pumping effect by centrifugal action produced by the taper roller bearing and the central supply of the liquid along the axis of the bearing and the plate, a considerable improvement was obtained in the operation of the pump at high rotational speeds.

It has been found that the production of this sleeve presented some difficulties: in fact the external diameter of the sleeve at the end of machining has to be calibrated by truing. The fact that the grooves are formed along generatrices has the result that the flanges thereof are perpendicular to the truing tool, and truing faults result from this which make themselves felt by leakages between the different flows which the sleeve is intended to separate.

Figure 8:
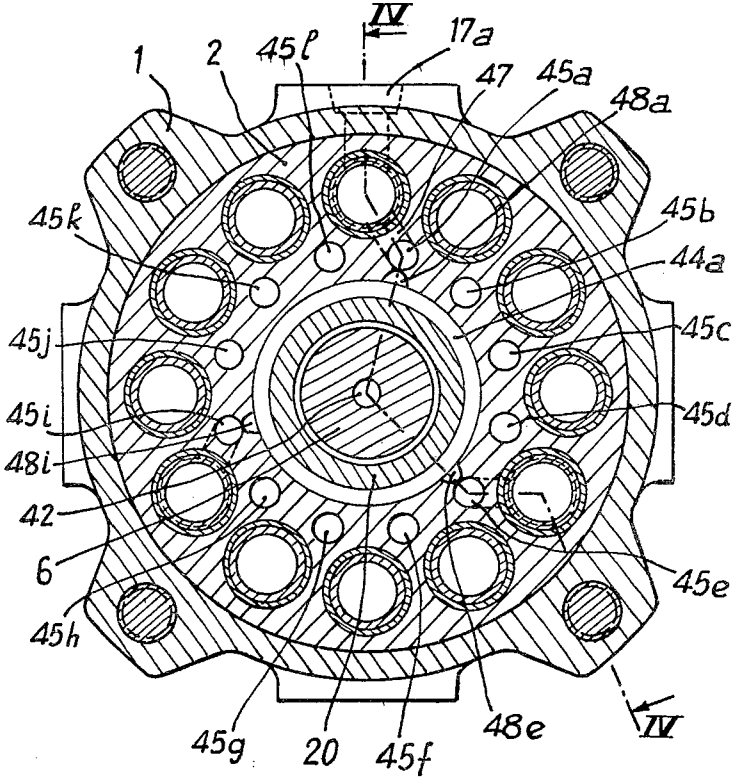
FIG. 8 shows a sectional view taken on the line V—V of FIG. 7.
Figure 7:
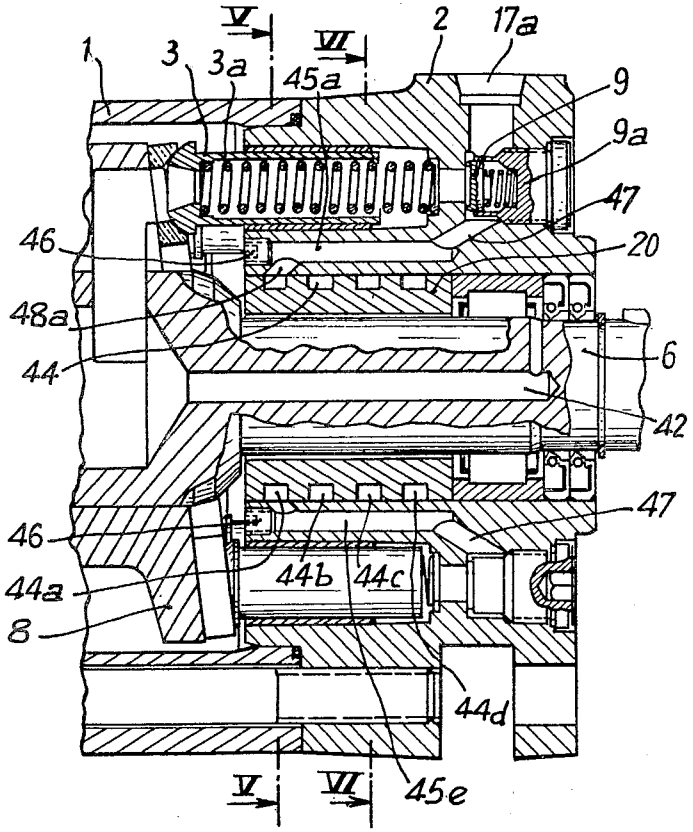
FIG. 7 shows a partial view in section taken on the line IV—IV of FIG. 8 illustrating a modified constructional form of the sleeve and the pump body.
Figure 9:
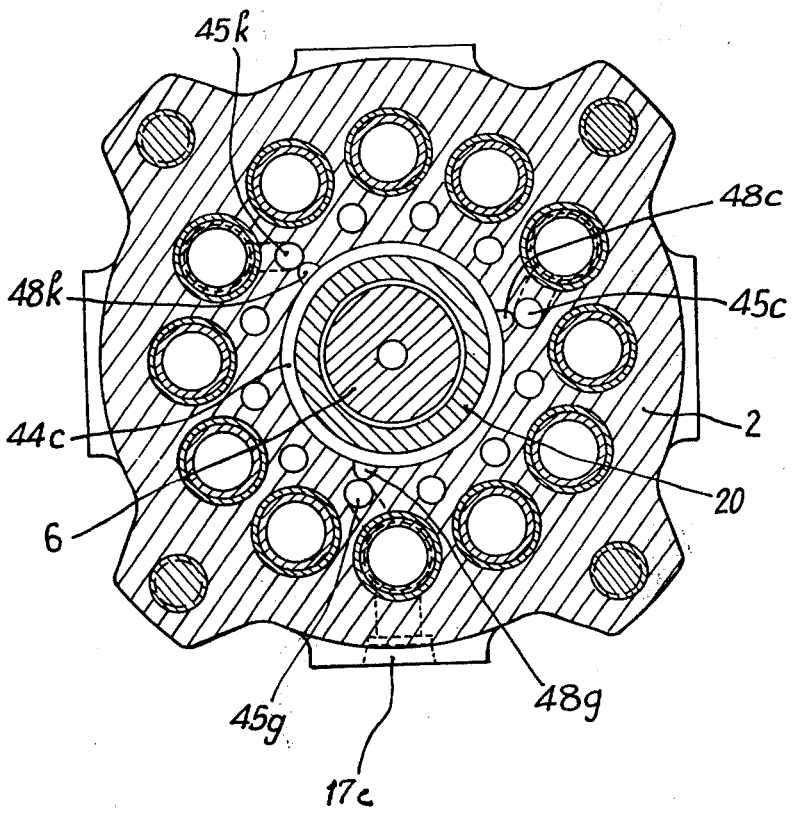
FIG. 9 shows a sectional view taken on the line VI—VI of FIG. 7.

FIGS. 7, 8 and 9 show a constructional variant with the object of facilitating the machining of the sleeve 20.

Referring now to these Figures, it can be seen that the sleeve 20 comprises a plurality of circular grooves 44. In the example illustrated, the pump is to have four separate discharge flows and therefore the sleeve 40 comprises four circular grooves denoted by references 44*a*, 44*b*, 44*c* and 44*d*.

From the solid portion of the barrel 2 of the pump body there are formed a plurality of ducts 45 parallel to the pistons 3 and of the same number. In the example illustrated the pump comprises 12 pistons 3 and therefore there are 12 ducts 45 denoted by references 45*a* to 45*l*.

Each duct 45 is closed at one of its ends by a plug 46 and communicates at its other end with the piston 3, to which it corresponds, by a duct 47 opening downstream of the non-return valve 9.

On the other hand, each duct 45 communicates with a single groove by means of a duct 48*a*, 48*b*, to 48*l*.

In the example illustrated, the ducts 45*a*, 45*e* and 45*i* all communicate with the groove 44*a* by way of ducts 48*a*, 48*e* and 48*i* and therefore the deliveries of the three corresponding pistons 3 communicate with one another and issue from the pump by way of the orifice 17a.

In order to make FIGS. 8 and 9 clearer and easier to read, all twelve ducts 47 have not been shown in broken lines, nor the four outlet orifices 17, but only a single group of pistons in each Figure has been shown.

Thus, in FIG. 8 there has been shown in section the groove 44*a* and the ducts 48*a*, 48*e* and 48*i* which open into this groove 44*a*, and also the only ducts 47 which corresponds to the three ducts 45*a*, 45*e* and 45*i* concerned; in a manner similar to FIG. 9 there has been shown in section the groove 44c and the ducts 48*c*, 48*g* and 48*k* which open into this groove 44*c* and also the only ducts 47 which correspond to the three ducts 45*c*, 45*g* and 45*k* concerned and also the outlet orifice 17*c*.

In the example illustrated there are 12 pistons 3 which are grouped in threes with a spacing of 120° so that the pump supplies four separate outlet flows; it will be apparent that it is possible if desired to modify this grouping by making a larger number of ducts 45 communicate with one and the same groove 44; in this way it is possible to provide any desired grouping.

For reasons of balancing the pump, it is preferable that the numbers of ducts 45 which are grouped should be equal, for example the pistons should thus be grouped in twos, in threes, in fours or in sixes, the total number n of pistons and ducts being divisible by the number p of grouped ducts, and the result being the number $q$ of flows; however, it is possible to arrange groupings in unequal numbers $p, p', p''$, provided that, with each duct 45 connected only to one groove, the sum of $p + p' + p''$ is in fact equal to $n$.

What is claimed is:

1. A swash plate pump of the type comprising a plurality of pistons bearing against a plate driven by a driving shaft, said plate being inclined relatively to said driving shaft in such a manner that the pistons are given a reciprocating movement when said plate is driven by said shaft, in which the drive shaft has a first portion and a hollow portion, which hollow portion forms an axial conduit for admission of a hydraulic liquid; said plate being mounted on said shaft at the junction between said first portion and said hollow portion, said plate having a recess communicating with said axial liquid supply duct and a port for distribution of the liquid to said pistons, said port being formed on the rear face of said plate, said plurality of pistons being arranged in a circle concentrically with said first portion of said shaft and bearing against said rear face of said plate, and a taper roller bearing mounted on said hollow portion of said shaft and against which the front face of said plate bears.

2. A pump according to claim 1, in which said plate has formed on its face a port corresponding to said distribution port of its rear face so that the liquid centrifuged through said taper roller bearing passes through said plate.

3. A pump according to claim 1 wherein the delivery flows of said pistons are grouped in separate groups so that the pump has several independent outlet flows, the means for grouping of delivery flows of the pistons comprising a cylindrical sleeve surrounding said first portion of said shaft, said sleeve having internal ducts formed in separate planes perpendicular to the axis of said sleeve and grooves formed on the external surface of said sleeve along generatrices of said sleeve; said grooves and said ducts providing communication with one another and with an outlet orifice for certain delivery flows.

4. A pump according to claim 3, wherein said sleeve has as many surface grooves as there are pumping pistons, the grooves of the same group having the same length and this length being equal to the distance separating the outlet duct from the plane containing the corresponding internal ducts.

5. A pump according to claim 1 further comprising a non-return valve on the outlet side of each piston, means for grouping the delivery flows of said pistons in separate groups so that the pump has several independent output flows, said grouping means comprising a cylindrical sleeve concentric with the circle formed by the pistons and having as many parallel circular grooves formed thereon as the pump is provided with outlet flows, a plurality of ducts are formed in the body of the pump barrel, parallel to the pumping pistons and equal in number thereto, each duct communicating with a piston by way of a duct opening downstream of the non-return valve of said piston and communicating with a groove on said sleeve.

6. A pump according to claim 5 comprising n pistons, q independent outlet flows, wherein the sleeve comprises q circular parallel grooves, and the barrel n ducts, a number $p, p'\ p''$ of ducts communicating with one and the same groove, the sum of the numbers $p + p' + p'' \ldots$ being equal to $n$.

7. A pump according to claim 6 wherein the numbers p, p' and p'' are equal to $n/q$.

8. A pump according to claim 7 comprising twelve pumping pistons and for outlet flows, wherein said sleeve comprises four circular grooves and the barrel comprises twelve ducts, three ducts situated at 120° communicating with one and the same groove.

9. A pump according to claim 1, wherein said first portion of the driving shaft is held by a bearing, in which said first portion of said driving shaft comprises an axial bore opening at the centre of the central supply conduit, said bore communicating with a cylindrical space formed between said driving shaft and said sleeve surrounding this shaft by means of a duct formed through said shaft, the bearing of said shaft being situated between this duct and the cylindrical space so that the hydraulic liquid path can pass through it.

10. A pump according to claim 1 wherein said distribution port of said plate is crescent-shaped.

11. A pump according to claim 10 wherein the port formed on the front of the plate is crescent-shaped and corresponding to the distribution port.

12. A pump according to claim 1 wherein said first portion of said shaft has a passage with an inlet communicating with the hollow portion of the shaft and an outlet communicating with the exterior of said first portion.

* * * * *